US006164164A

United States Patent [19]

Dixon, Jr.

[11] Patent Number: 6,164,164

[45] **Date of Patent: *Dec. 26, 2000**

[54] THREADED STUD SETTING TOOL

[75] Inventor: Louis N. Dixon, Jr., Cincinnati, Ohio

[73] Assignee: General Electric Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/197,181

[22] Filed: Nov. 20, 1998

[51] Int. Cl.[7] ..... B25B 13/48

[52] U.S. Cl. ..... 81/53.2; 81/459

[58] Field of Search ..... 81/459, 53.2

[56] References Cited

U.S. PATENT DOCUMENTS

| | | | |
|---|---|---|---|
| 1,438,269 | 12/1922 | Sehrt | 81/53.2 |
| 1,566,691 | 12/1925 | Perry | 81/53.2 |
| 2,775,153 | 12/1956 | Parhaniemi | 81/53.2 |
| 2,817,987 | 12/1957 | Bosse | 81/53.2 |
| 3,104,569 | 9/1963 | Davis et al. | 81/53.2 |
| 3,106,233 | 10/1963 | Wolny | 81/53.2 X |
| 3,587,363 | 6/1971 | Rogers | 81/53.2 |
| 4,692,075 | 9/1987 | Metz . | |
| 5,544,992 | 8/1996 | Clobanu et al. . | |
| 5,762,456 | 6/1998 | Aasgaard . | |

*Primary Examiner*—D. S. Meislin

*Attorney, Agent, or Firm*—Andrew C. Hess; Nathan D. Herkamp

[57] ABSTRACT

A fastening system includes a tool for fastening a threaded stud having external first threads. The tool includes a longitudinally extending casing having a cavity with an open first end and an aperture mount connected to the casing at a second end of the cavity and spaced apart a first distance from the open end. A threaded first aperture having internal second threads is disposed within the mount and has a centerline that passes through the open end and is threaded to receive the stud through an open aperture first end and to receive a threaded shank through an open aperture second end. A stop is provided for stopping the threaded shank from threading more than a predetermined first distance into the first aperture so that the stud protrudes a predetermined height from the part it is screwed into.

13 Claims, 4 Drawing Sheets

THREADED STUD SETTING TOOL

BACKGROUND OF THE INVENTION

1. Field of the Invention

The present invention relates to threaded stud insertion apparatus and, more particularly, to a tool for inserting threaded studs into a threaded aperture such that the stud protrudes a predetermined distance.

2. Discussion of the Background Art

Threaded studs are used very extensively in the aerospace field. The stud is secured to a workpiece by a threaded first end threaded into a threaded aperture in the workpiece. A threaded second end protrudes from a surface of the workpiece wherein the threaded second end is used to secure another part to the workpiece. It is highly desirable to have threaded second ends of multiple threaded studs protrude the same distance from the surface of the workpiece. To this end, the present invention was made.

SUMMARY OF THE INVENTION

A tool includes a longitudinally extending casing having a cavity with an open first end, an aperture mount connected to the casing at a second end of the cavity and spaced apart a first distance from the open end, and a threaded first aperture disposed within the mount having internal first threads. The first aperture has a centerline that passes through the open end and a threaded shank having external second threads is engageable with first threads in the first aperture. A stop for stopping the threaded shank from threading more than a predetermined first distance into the first aperture is associated with the threaded shank and the mount.

The preferred embodiment of the tool includes a first torque member for applying a torque to and turning the threaded shank in the first aperture and a second torque member for applying a torque to the casing. The first and second torque members may be first and second knurled knobs, respectively. The first knurled knob may be a circular cylindrical block having a first knurled circumferential edge and the threaded shank attached to a center point of the cylindrical block. The cylindrical block is engageable with the mount to form the stop. The first knurled knob may be an annular flange attached to and surrounding the casing and having a second knurled circumferential edge and the casing may be annular. The mount may be a annular top of the casing that caps the cavity such that the annular top is centered about the centerline. In a more particular embodiment of the present invention at least one spacer may be disposed around the threaded shank between the mount and the first torque member.

Another embodiment of the present invention provides a fastening system with a threaded stud having external first threads and the tool for fastening the stud. The tool includes a longitudinally extending casing having a cavity with an open first end and an aperture mount connected to the casing at a second end of the cavity and spaced apart a first distance from the open end. A threaded first aperture having internal second threads is disposed within the mount and has a centerline that passes through the open end. A threaded shank having external third threads engage the second threads in the first aperture and the first aperture is threaded to receive the stud through an open aperture first end and to receive threaded shank through an open aperture second end. A stop is provided for stopping the threaded shank from threading more than a predetermined first distance into the first aperture. A second threaded aperture is disposed in an object and is formed to threadingly receive said threaded stud. The second threaded aperture has a depth greater than a predetermined second distance that said stud is received in said second threaded aperture.

ADVANTAGES OF THE INVENTION

Among the advantages provided by the present invention is that the tool is simple to use, hand held and operated, durable, compact, and easy to use in difficult to access areas. The tool can be used to both assemble studs in parts and qualifies the stud's height of protrusion. The tool, though typically made of two screw together parts, never needs to be disassembled to operate, only loosened. This increases the tool's reliability and lessens the chance of one part being lost. The tool can be used to install a stud and assure disengagement of the tool from the stud with no movement of the stud once the stud is set to its proper height. Furthermore, the tool may be used to remove the stud in a non-destructive manner.

BRIEF DESCRIPTION OF THE DRAWINGS

The novel features believed characteristic of the present invention are set forth and differentiated in the claims. The invention, together with further objects and advantages thereof, is more particularly described in conjunction with the accompanying drawings in which:

DETAILED DESCRIPTION

Figure 1:
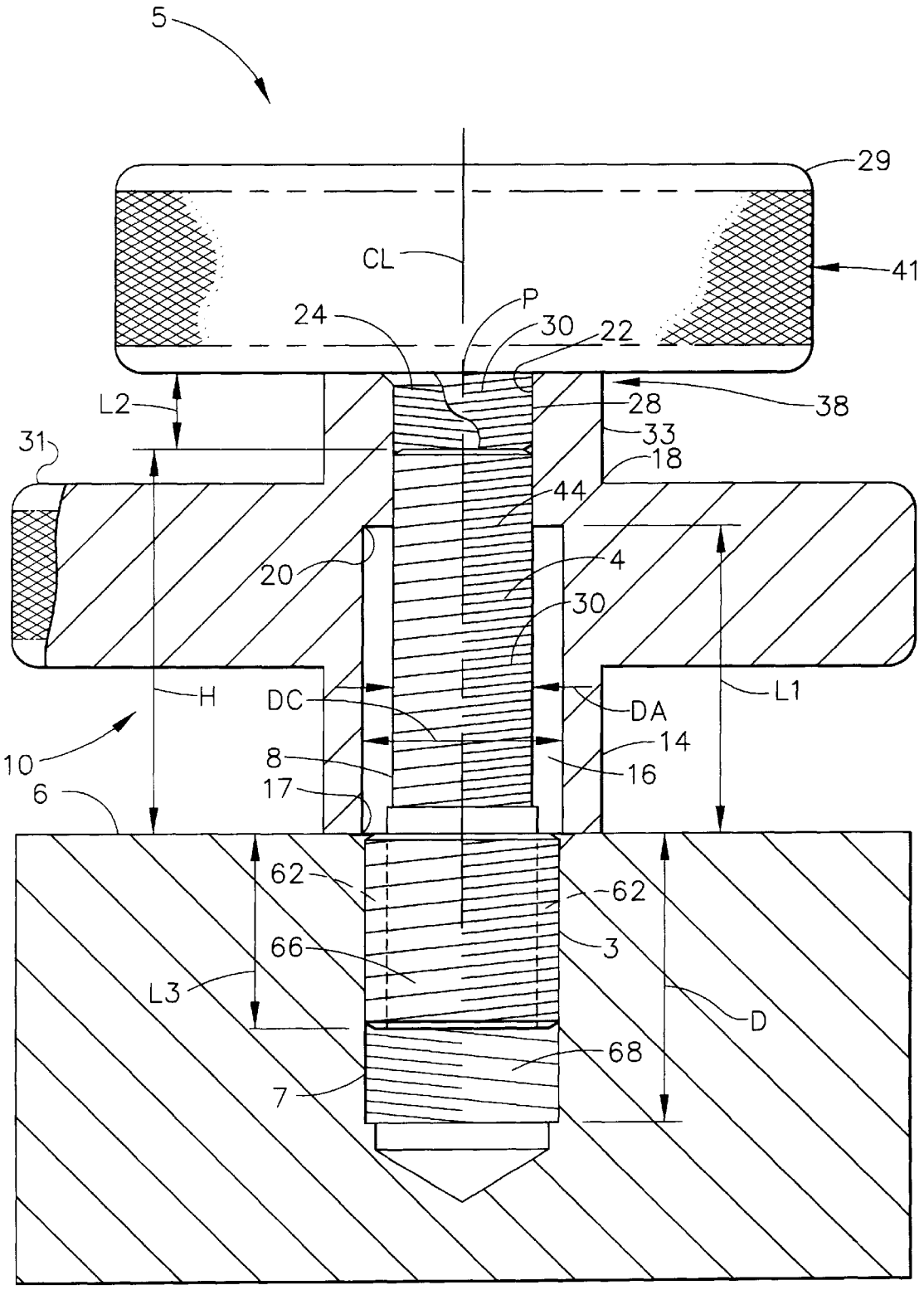
FIG. 1 is a partial cutaway elevated view illustrating a threaded stud assembly tool in accordance with an exemplary embodiment of the present invention.
Figure 2:
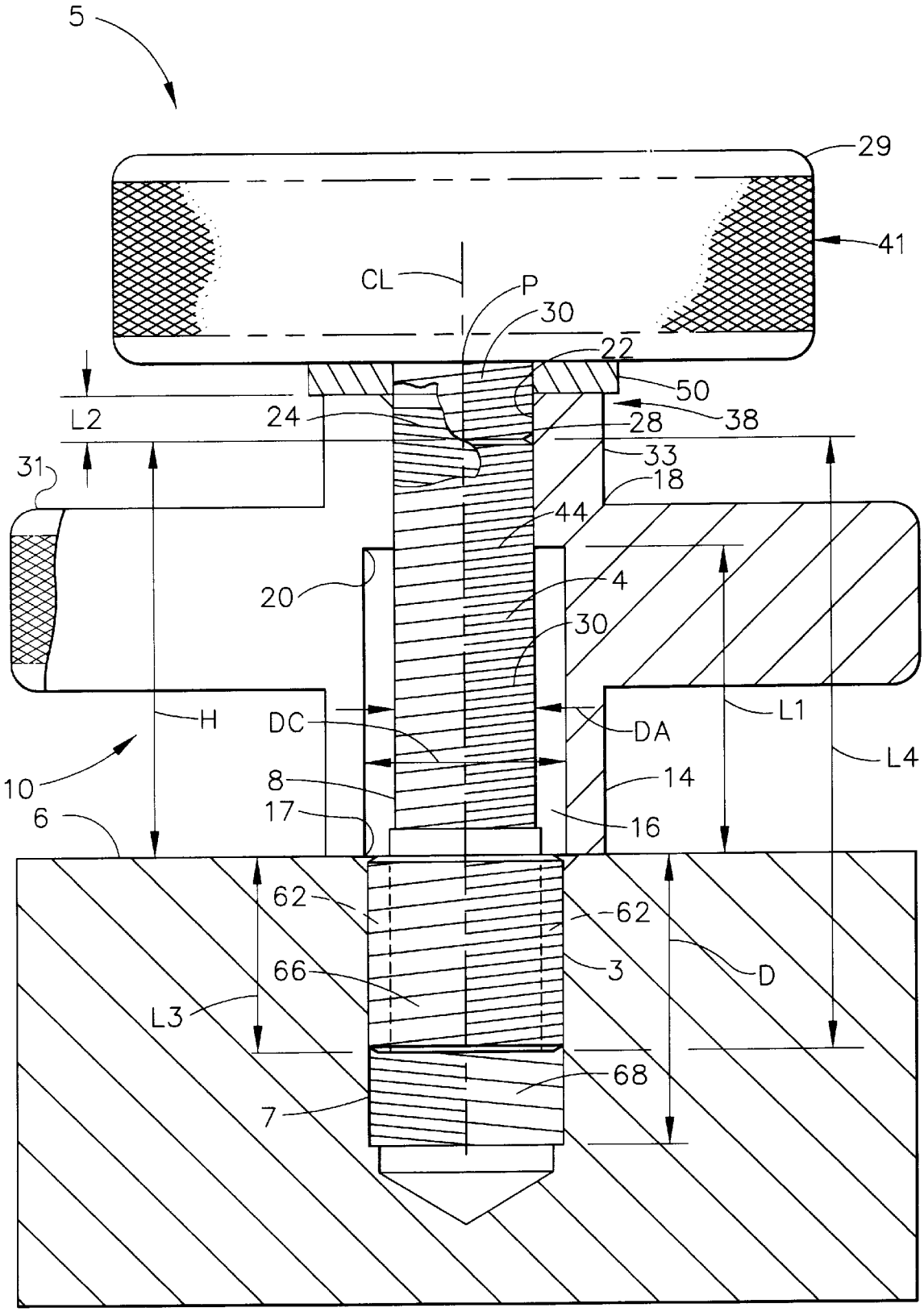
FIG. 2 is a partial cutaway elevated view illustrating view of the tool in FIG. 1 illustrating a second embodiment of the tool with a different length stud.

Referring now to the drawings in detail wherein identical numerals indicate the same elements throughout the figures. FIGS. 1 and 2 illustrate a fastening system 5 with a tool 10 to screw threaded studs 8 into a second threaded aperture 7 disposed in an object or part 6 so that the studs protrude a consistent predetermined height H. Each of the second threaded apertures 7 is formed to threadingly receive one of the threaded studs 8. The second threaded aperture 7 has a depth D greater than a predetermined third distance L3 that the stud 8 extends into or is received within the second threaded aperture 7 when the stud protrudes the predetermined height H from the part 6. Note that the stud 8 is illustrated as having a lower portion 3 that is wider than its upper portion 4. This is typical as is a constant diameter construction of the studs.

The tool 10 has a longitudinally extending preferably annular casing 14 encompassing a cavity 16 with an open first end 17. An aperture mount 18 connected to the casing 14 at a second end 20 of the cavity 16 is spaced apart a first distance L1 from the open first end 17. A threaded first aperture 22 disposed within the aperture mount 18 has internal first threads 24 and a centerline CL that extends through the open first end 17. A threaded shank 28 having external second threads 30 is engageable with the internal first threads 24 in the first aperture 22.

The shank 28 is attached to a preferably knurled first knob 29 which serves as a convenient handle to turn and apply torque to the shank. The knurled first knob 29 may be in the form of a circular cylindrical block having a first knurled circumferential edge 41 with the threaded shank 28 attached to a center point P of the cylindrical block. The cylindrical block is engageable with the mount to form a stop 38 for preventing the threaded shank 28 from threading more than a predetermined second distance L2 into the first aperture is associated with the threaded shank and the aperture mount 18. A preferably knurled second knob 31 serves as a convenient second handle to hold and apply a counter torque to the casing 14 and may, as is illustrated in the FIGS., be formed as a flange around the casing 14.

The aperture mount 18 may be an annular top 33 of the annular casing 14 that caps the cavity 16 and through which the threaded first aperture 22 is disposed such that the cylindrical top is centered about the centerline CL. A cavity diameter DC of the cavity 16 is wider than an aperture diameter DA of the first aperture 22.

Figure 4:
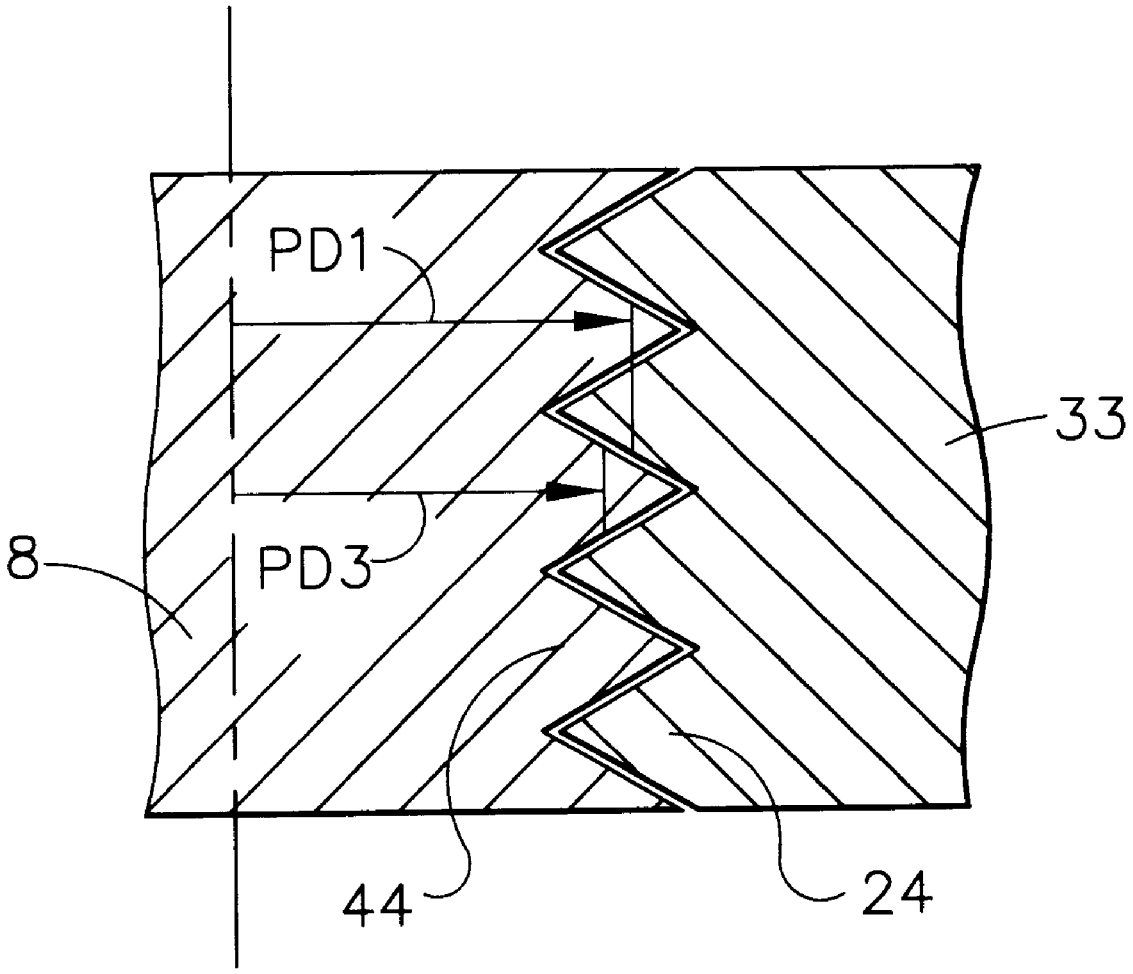
FIG. 4 is a cross-sectional schematic view illustrating a loose fit between threads of a first aperture and the threaded stud in FIGS. 1 and 2.

In order to easily remove the tool 10 and more particularly the casing 14, the upper portion 4 of the stud 8 includes external third threads 44 formed to engage the internal first threads 24 in the first aperture 22 with a loose fit. Illustrated in FIG. 4 is one method of accomplishing by forming the internal first threads 24 in the first aperture 22 with a slightly greater first thread pitch diameter PD1 than a third thread pitch diameter PD3 of the external third threads 44. Note the difference between the first thread pitch diameter PD1 and the third thread pitch diameter PD3 is exaggerated for clarity. In order to further facilitate the removal of the tool 10, the first aperture 22 is designed to receive only a small portion of the stud 8 before it contacts the fully inserted or screwed in threaded shank 28.

FIG. 2 illustrates a more particular embodiment of the present invention with at least one spacer 50 disposed around the threaded shank 28 between the mount 18 and the first knob 29 (also referred to as a first torque member). This allows the same tool 10 to be used with stud 8 of different stud lengths L4 and/or different pre-determined heights H.

In operation the threaded shank 28 is screwed all the way into the threaded first aperture 22, the predetermined second distance L2, using the knurled first knob 29. The stud 8 is then threaded into the threaded first aperture 22 until it meets and stops against the threaded shank 28. The stud 8 is then threaded into the second threaded aperture 7 by using the knurled first knob 29 until the tool 10 stops rotating as the casing 14 contacts the object or part 6. At this point, the stud 8 extends or protrudes from the part 6 the predetermined height H. Next, the casing 14 is held in place by one hand using the knurled second knob 31 while the other hand unscrews the shank 28 from the threaded first aperture 22 using the knurled first knob 29. The casing 14 is then easily removed by turning the casing to unscrew the stud 8 from the threaded first aperture 22. The stud 8 remains stationary because the fit of the external third threads 44 on the upper portion 4 of the stud with the first threads 24 in the first aperture 22 is looser than the fit of external fourth threads 66 in the lower portion 3 of the stud 8 with internal fifth threads 68 of the second threaded aperture 7. The stud 8 may be removed by reversing this procedure.

Figure 3:
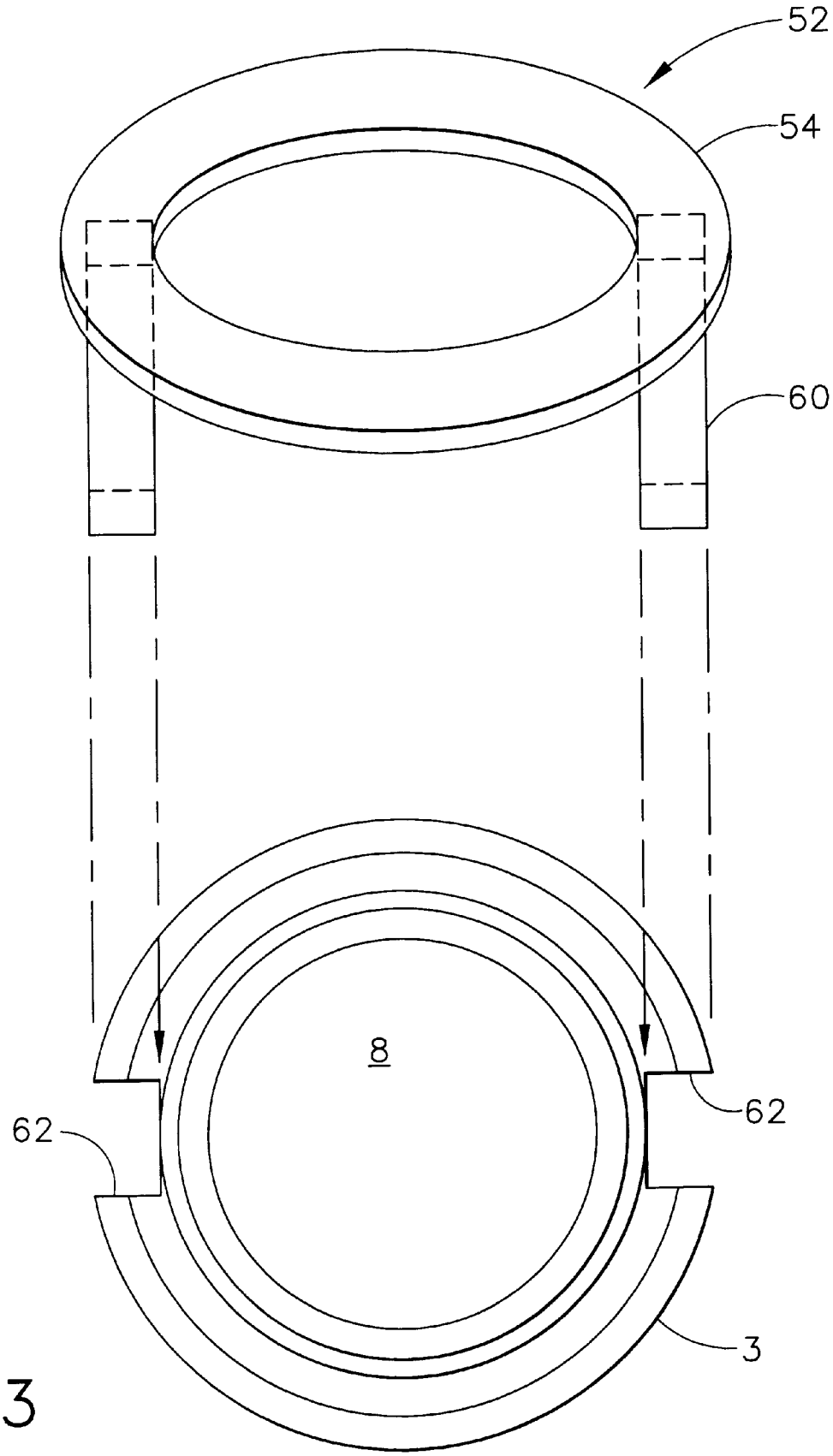
FIG. 3 is a partial perspective and partial cross-sectional view illustrating a staking ring for the threaded stud in FIGS. 1 and 2.

FIG. 3 illustrates the use of a commonly used stake ring 52 to rotationally secure the stud 8 in the second threaded aperture 7. The stake ring 52 has an annular body 54 with circumferentially oppositely disposed stakes 60 depending therefrom. The stake ring 52 is disposed over the stud 8 and after the stud is inserted into the second threaded aperture 7 and the tool 10 removed. Then the stake ring 52 is pressed down and the stakes 60 slide into stake grooves 62 extending through the external fourth threads 66 in the lower portion 3 of the stud 8. The stakes 60 cut the internal fifth threads 68 of the second threaded aperture 7 and rotationally secures the stud 8 within the second threaded aperture.

While the preferred embodiment of our invention has been described fully in order to explain its principles, it is understood that various modifications or alterations may be made to the preferred embodiment without departing from the scope of the invention as set forth in the appended claims.

What is claimed is:

1. A tool comprising:

a longitudinally extending annular casing having a cavity with an open first end, an aperture mount connected to said casing at a second end of said cavity and spaced apart a first distance from said open end, a threaded first aperture disposed within said mount having internal first threads, said first aperture having a centerline that passes through said open end, a threaded shank having external second threads engageable with first threads in said first aperture, said threaded shank having a shank diameter substantially equal to an aperture diameter of said first aperture, said cavity having a cavity diameter wider than said aperture diameter, said mount comprising an annular top of said casing that caps said cavity and said annular top is centered about said centerline, a first torque means for applying a torque to and turning said threaded shank in said first aperture, a second torque means for applying a torque to said casing, and a stop means for stopping said threaded shank from threading more than a predetermined first distance into said first aperture, wherein said first and second torque means are first and second knurled knobs respectively, said first knurled knob is a circular cylindrical block having a first knurled circumferential edge, said threaded shank is attached to a center point of said cylindrical block and said cylindrical block is engageable with said mount to form said stop means, said first knurled knob is an annular flange attached to and surrounding said casing and having a second knurled circumferential edge.

2. A tool as claimed in claim 1 further comprising at least one spacer disposed around said threaded shank between said mount and said first torque means.

3. A fastening system comprising:

a threaded stud having external third threads and a tool for fastening said stud;

said tool comprising:

a longitudinally extending casing having a cavity with an open first end;

an aperture mount connected to said casing at a second end of said cavity and spaced apart a first distance from said open end;

a threaded first aperture having internal first threads, disposed within said mount, and having a centerline that passes through said open end;

a threaded shank having external second threads engageable with said first threads in said first aperture, said first aperture threaded to receive said stud through an open aperture first end and to receive said threaded shank through an open aperture second end, a stop means for stopping said threaded shank from threading more than a predetermined first distance into said first aperture, a first torque means for applying a torque to and turning said threaded shank in said first aperture and a second torque means for applying a torque to said casing, a loose fit between said external third threads and said internal first threads, and said internal first threads have a first thread pitch diameter slightly greater than a third thread pitch diameter of said external third threads.

4. A fastening system as claimed in claim 3 wherein said first and second torque means are first and second knurled knobs respectively.

5. A fastening system as claimed in claim 4 wherein said casing is annular, said mount comprises a annular top of said casing that caps said cavity and said annular top is centered about said centerline, said first knurled knob is a circular cylindrical block having a first knurled circumferential edge, said threaded shank is attached to a center point of said cylindrical block, said cylindrical block is engageable with said mount to form said stop means, and said second knurled knob is an annular flange attached to and surrounding said casing and having a second knurled circumferential edge.

6. A fastening system for use with an object having a second threaded aperture disposed in the object, said second threaded aperture having a depth greater than a predetermined second distance, said fastening system comprising:

a threaded stud having external third threads and a tool for fastening said stud;

said tool comprising:

a longitudinally extending casing having a cavity with an open first end;

an aperture mount connected to said casing at a second end of said cavity and spaced apart a first distance from said open end;

a threaded first aperture having internal first threads, disposed within said mount, and having a centerline that passes through said open end;

a threaded shank having external second threads engageable with said first threads in said first aperture, said threaded shank having a shank diameter substantially equal to an aperture diameter of said first aperture, said cavity having a cavity diameter wider than said aperture diameter, said first aperture threaded to receive said stud through an open aperture first end and to receive said threaded shank through an open aperture second end, and a stop means for stopping said threaded shank from threading more than a predetermined first distance into said first aperture.

7. A fastening system as claimed in claim 6 further comprising a first torque means for applying a torque to and turning said threaded shank in said first aperture and a second torque means for applying a torque to said casing.

8. A fastening system as claimed in claim 7 further comprising a loose fit between said external third threads and said internal first threads.

9. A fastening system as claimed in claim 6 wherein said threaded stud is formed to be received in the second threaded aperture to a depth equal to the predetermined second distance.

10. A fastening system as claimed in claim 9 further comprising a first torque means for applying a torque to and turning said threaded shank in said first aperture and a second torque means for applying a torque to said casing.

11. A fastening system for use with an object having a second threaded aperture disposed in the object, said second threaded aperture having a depth greater than a predetermined second distance, said fastening system comprising:

a threaded stud having external third threads and a tool for fastening said stud;

said tool comprising:

a longitudinally extending casing having a cavity with an open first end;

an aperture mount connected to said casing at a second end of said cavity and spaced apart a first distance from said open end;

a threaded first aperture having internal first threads, disposed within said mount, and having a centerline that passes through said open end;

a threaded shank having external second threads engageable with said first threads in said first aperture, said first aperture threaded to receive said stud through an open aperture first end and to receive said threaded shank through an open aperture second end, a stop means for stopping said threaded shank from threading more than a predetermined first distance into said first aperture, said threaded stud formed to received in the second threaded aperture to a depth equal to the predetermined second distance, a first torque means for applying a torque to and turning said threaded shank in said first aperture and a second torque means for applying a torque to said casing, and a loose fit between said external third threads and said internal first threads such that said internal first threads have a first thread pitch diameter slightly greater than a third thread pitch diameter of said external third threads.

12. A fastening system as claimed in claim 11 wherein said first and second torque means are first and second knurled knobs respectively.

13. A fastening system as claimed in claim 12 wherein said casing is annular, said mount comprises a annular top of said casing that caps said cavity and said annular top is centered about said centerline, said first knurled knob is a circular cylindrical block having a first knurled circumferential edge, said threaded shank is attached to a center point of said cylindrical block, said cylindrical block is engageable with said mount to form said stop means, and said second knurled knob is an annular flange attached to and surrounding said casing and having a second knurled circumferential edge.

* * * * *